US005480211A

United States Patent [19]

Douglas et al.

[11] Patent Number: 5,480,211

[45] Date of Patent: Jan. 2, 1996

[54] HIGH CHAIR APPARATUS FOR ATTACHMENT TO A TABLE OR THE LIKE

[75] Inventors: Homer Douglas; Marshall L. Aberle, both of Grand Rapids; Phillip M. Parker, Kalamazoo, all of Mich.; Daniel R. Pinch, Columbus, Ind.; Robert A. Schwartzkopf, Grand Rapids, Mich.

[73] Assignee: Sassy, Inc., Northbrook, Ill.

[21] Appl. No.: 314,359

[22] Filed: Sep. 28, 1994

[51] Int. Cl.[6] ..... A47B 39/00

[52] U.S. Cl. ..... 297/174; 297/467; 297/335

[58] Field of Search ..... 297/250.1, 256.16, 297/174, 467, 135, 464, 368, 369, 373, 331, 335, 337; 403/104, 105, 107

[56] References Cited

U.S. PATENT DOCUMENTS

| | | | |
|---|---|---|---|
| 2,888,061 | 5/1959 | Berlin | 297/331 X |
| 3,052,500 | 9/1962 | Hyde . | |
| 3,059,965 | 10/1962 | Fornetti . | |
| 3,082,035 | 3/1963 | Goolsby | 297/174 |
| 3,133,760 | 5/1964 | Robinson | 297/174 |
| 3,397,010 | 8/1968 | Leimgruber | 297/174 |
| 4,230,362 | 10/1980 | Euwema et al. | 297/174 |
| 4,312,535 | 1/1982 | Smith | 297/174 |
| 4,506,928 | 3/1985 | Marion | 297/174 |
| 4,530,539 | 7/1985 | Gaber et al. | 297/174 |
| 4,568,120 | 2/1986 | Hoffman | 297/174 |
| 4,586,746 | 5/1986 | Day et al. | 297/174 |
| 4,629,247 | 12/1986 | Wu | 297/174 |
| 4,818,016 | 4/1989 | Mariol et al. | 297/174 |
| 4,863,216 | 9/1989 | Prescott | 297/174 |

*Primary Examiner*—Milton Nelson, Jr.
*Attorney, Agent, or Firm*—Dick and Harris

[57] ABSTRACT

A highchair apparatus for attachment to an elevated member, such as a table or the like. At least a portion of a frame supporting the highchair apparatus engages an upper surface of the elevated member. A clamping member, pivotally attached to the frame pivot housing at a first pivot, engages a lower surface of the elevated member and clamps the highchair apparatus to the elevated member. A cam member, pivotally attached to the frame pivot housing at a second pivot, restrainably secures the highchair apparatus to the elevated member, by engaging the clamping arm upon movement of the cam member from a substantially nonengaging position to a substantially engaging position, causing the clamping member to securely engage the lower surface of the elevated member, and further serving to lock the clamping member in secure engagement with the lower surface of the elevated member.

20 Claims, 3 Drawing Sheets

Fig 1
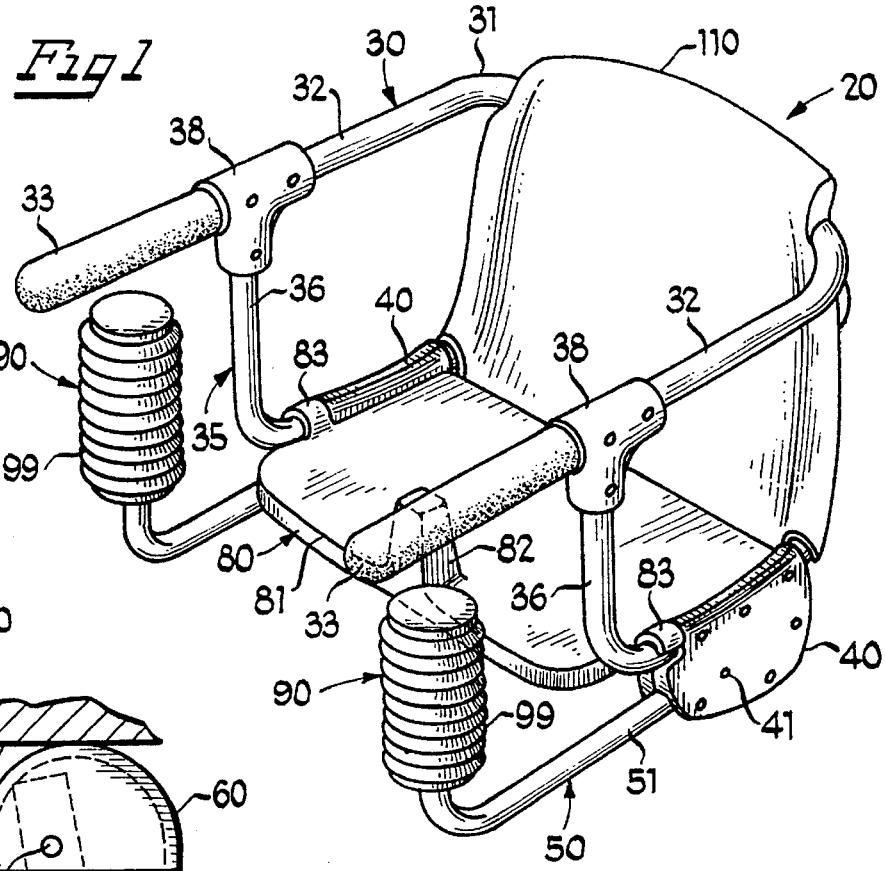
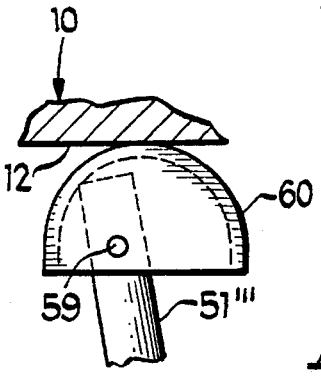
Fig 4
Fig 9
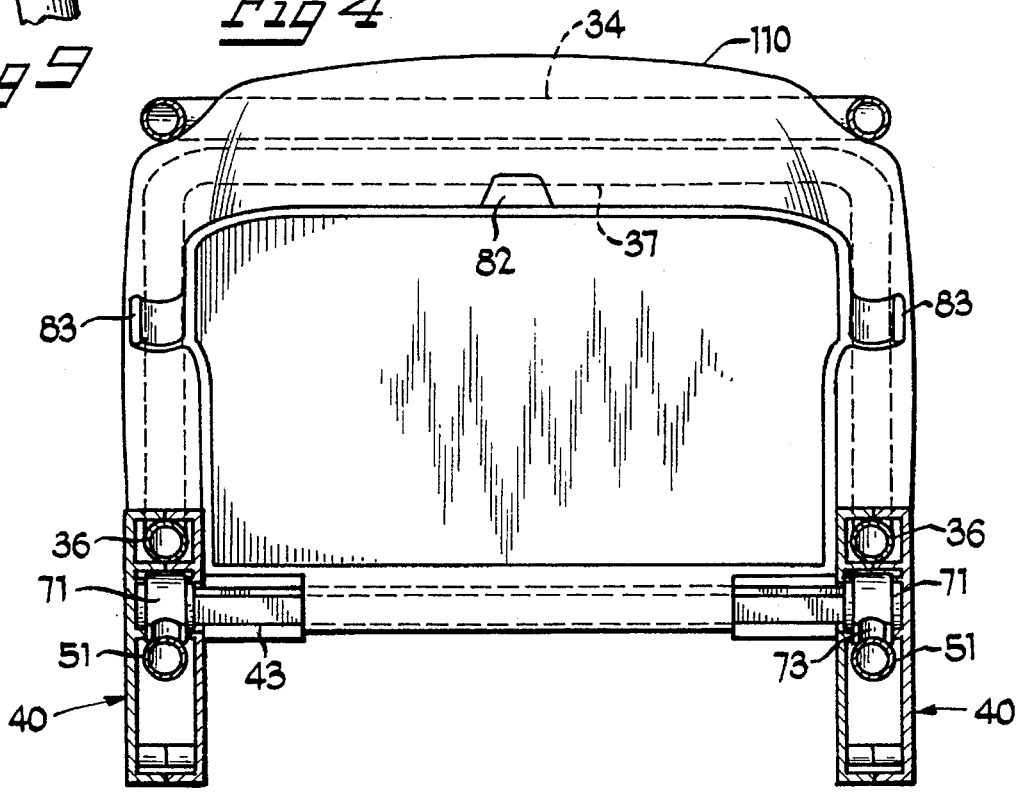

Fig 2
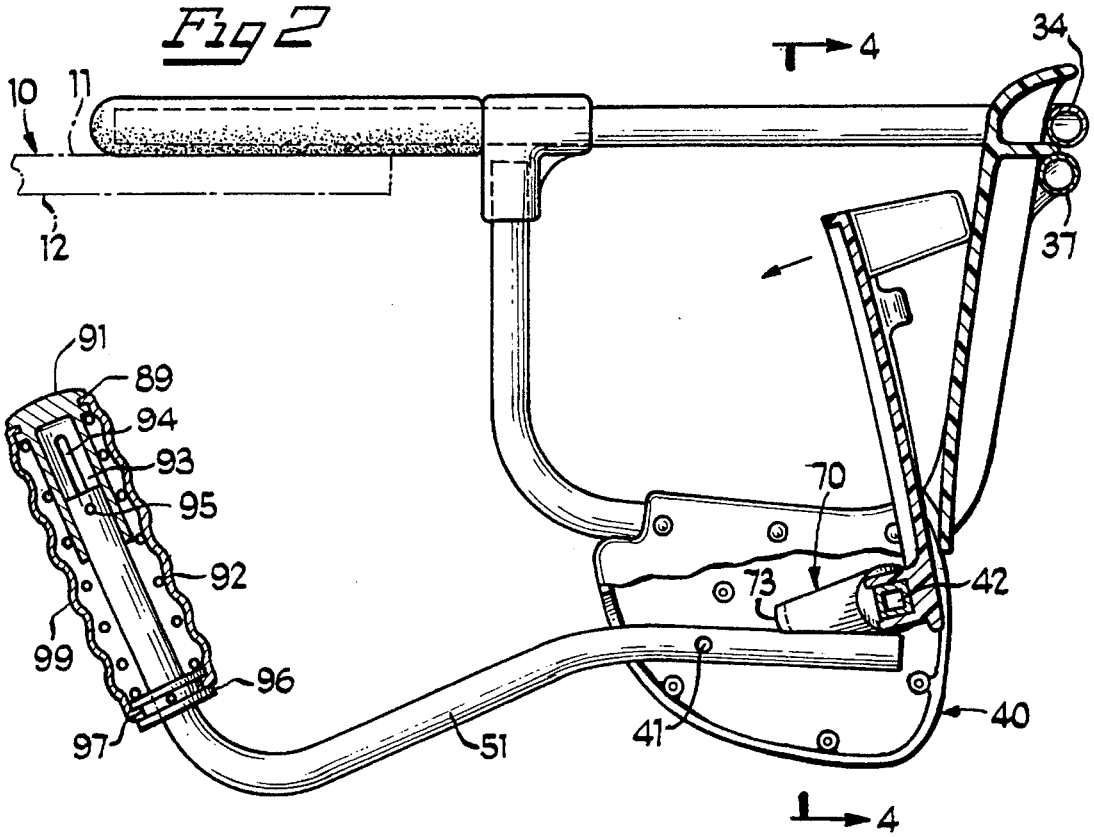
Fig 3
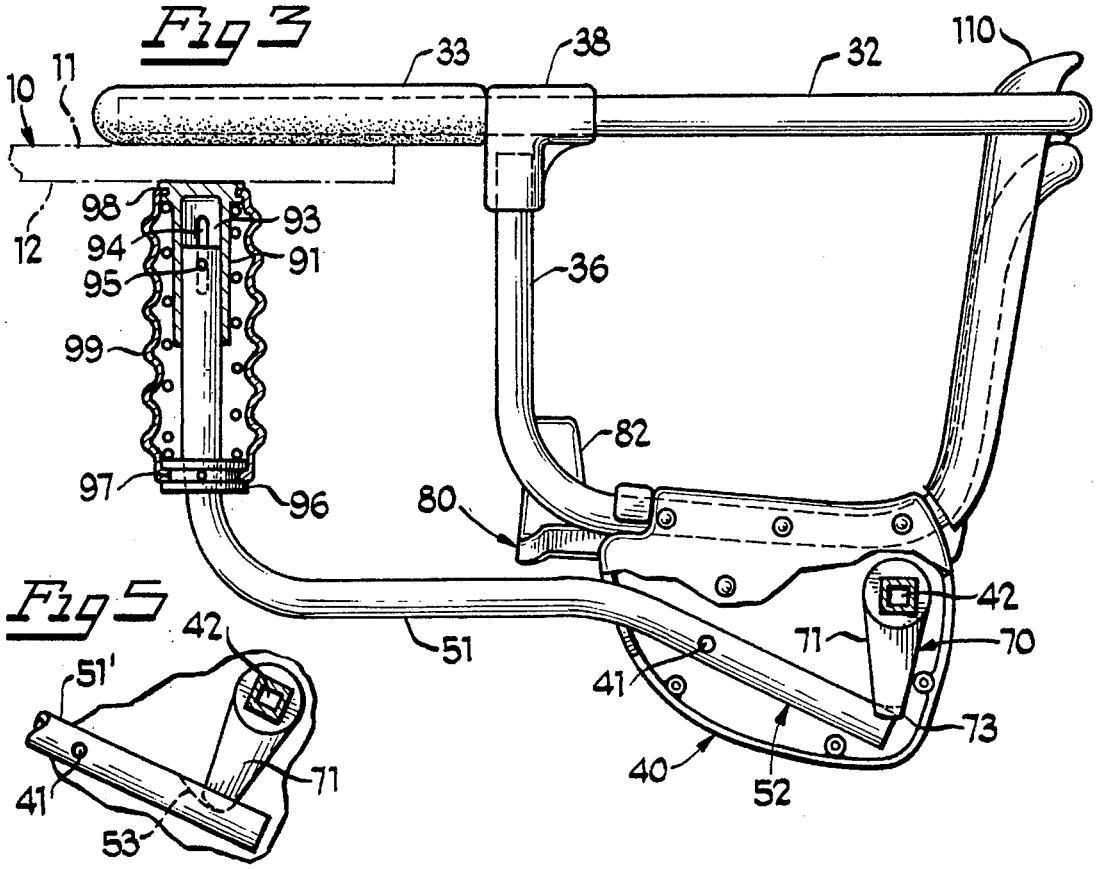
Fig 5

Fig 6
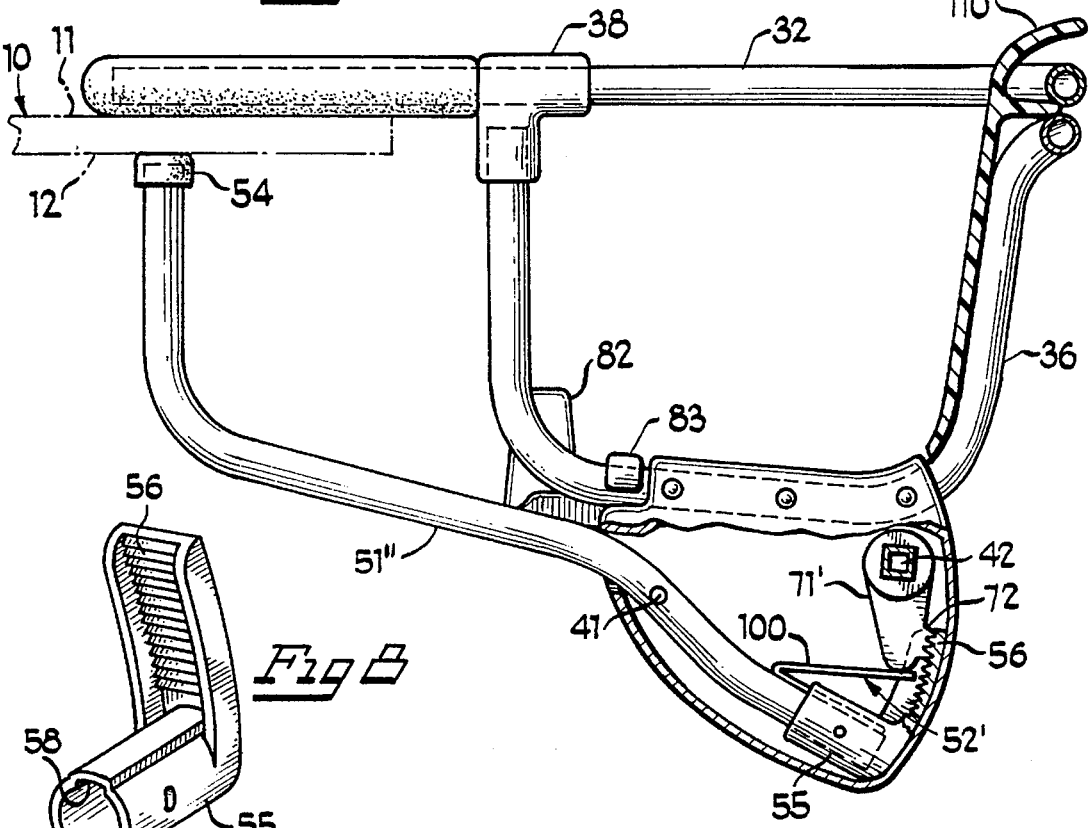
Fig 8
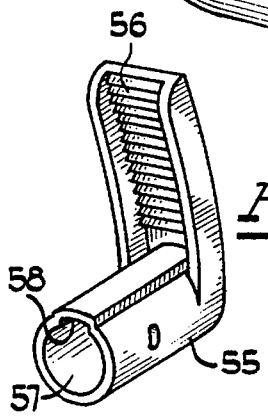
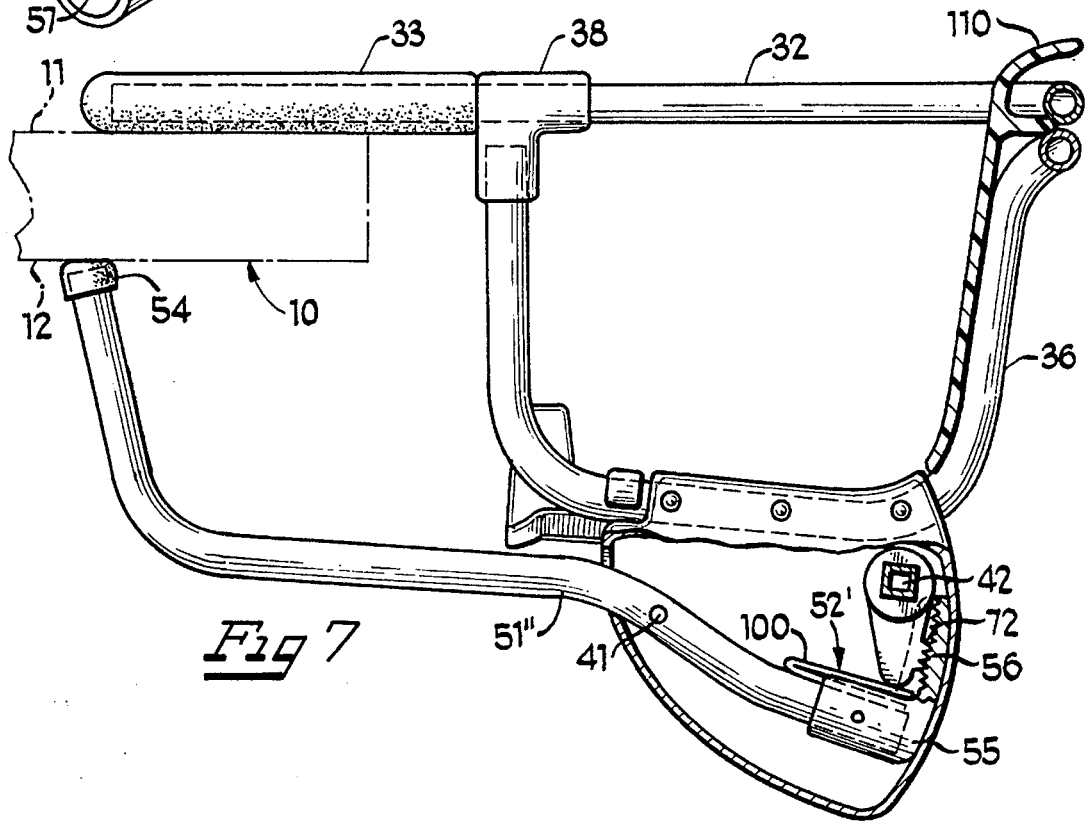
Fig 7

HIGH CHAIR APPARATUS FOR ATTACHMENT TO A TABLE OR THE LIKE

BACKGROUND OF THE INVENTION

The present invention relates in general to highchair apparatuses and, more particularly, to a highchair apparatus for attachment to an elevated member.

Highchair apparatuses for attachment to elevated members, such as tables or the like, have been popular for quite some time. Such apparatuses often referred to as "hook-on" type highchairs. Examples of such hook-on type highchairs are disclosed within Mariol, et al., U.S. Pat. No. 4,818,016 and Hoffman U.S. Pat. No. 4,568,120. While each of these prior art hook-on highchairs utilize distinctly different clamping mechanisms, each employs a relatively complex, latching ratchet mechanism to securely clamp the highchair to an elevated member, by clamping the elevated member between an overhanging arm and an underlying clamping arm. Besides being relatively complex, these ratcheting latch mechanisms are typically exposed, presenting a relatively unattractive appearance to the user.

Gaber et al., U.S. Pat. No. 4,530,539, discloses a hook-on highchair having a telescoping member integrally connected to the highchair seat which engages the lower surface of a table upon lowering of the seat portion of the highchair. This telescoping member does not serve to securely clamp the highchair to the table. Instead, the telescoping member serves only to enhance a conventional, cantilever type attachment of the highchair of the table, which requires the weight of a child placed within the seat to facilitate secured cantilever mounting.

Accordingly, it is an object of the present invention to provide a relatively simple, user-friendly latching mechanism for securing a highchair apparatus to an elevated member.

It is another object of the present invention to provide a highchair apparatus which is attachable to an elevated member by simply lowering a seat portion of the apparatus.

It is a further object of the present invention to provide a highchair apparatus having a concealed latching mechanism positioned away from and operably independently from the back portion of the baby seat itself.

These and other objects and features of the present invention will become apparent in view of the present specification, drawings and claims.

SUMMARY OF THE INVENTION

The present invention comprises a highchair apparatus for attachment to an elevated member having an upper surface, a lower surface and a thickness therebetween. The highchair apparatus includes frame means for supporting the highchair apparatus. At least a portion of the frame means engages the upper surface of the elevated member when the highchair apparatus is attached to the elevated member. Clamping means are pivotally attached to the frame means at a first pivot for clamping the highchair apparatus to the elevated member. At least a portion of the clamping means engages the lower surface of the elevated member upon attachment of the highchair apparatus to the elevated member.

Securement means are provided and pivotally attached to the frame means at a second pivot point, and are operably associated with the clamping means, for restrainably securing the highchair apparatus to the elevated member through clamping engagement by at least a portion of the frame means and clamping means with the upper and lower surfaces of the elevated member, respectively. The securement means cooperatively engage the clamping means upon movement of the securement means from a substantially nonengaging position to a substantially engaging position, prompting movement of the clamping means from a non-clamping position to a clamping position, securely engaging the lower surface of the elevated member, and, in turn, causing at least a portion of the frame means to securely engage the upper surface of the elevated member. The securement means further serve to lock the clamping means in secure engagement of the lower surface. This, in turn, also serves to lock at least a portion of the frame means in secure engagement of the upper surface, until force is exerted upon the securement means towards moving the securement means back from the substantially engaging position to the substantially nonengaging position.

A seat member is also pivotally attached to the frame means at the second pivot, and is positionable from a substantially undeployed position to a substantially deployed position. The securement means is fixed for rotation with the seat member, cooperatively engaging the clamping means so as to releasably force the clamping means into secure engagement of the lower surface of the elevated member upon prompted movement of the clamping means, when the seat member is moved from the substantially undeployed position to the substantially deployed position.

A backrest member is also provided and attached to the frame means. The backrest member and the seat member cooperate to form a chair in which a child may be seated upon movement of the seat member to its deployed position.

The seat member includes a top surface, and a horn member proximate the top surface. This horn member is positioned between the legs of a child seated upon the seat member when the seat member is in its substantially deployed position, serving to substantially preclude the child from sliding forward and exiting the highchair apparatus.

Also, in a preferred embodiment, the seat member further includes at least one limit member operatively attached to the seat member. The limit member releasably engages a portion of the frame means when the seat member is in the substantially deployed position. This, in turn, enhances stabilization of the seat member in its substantially deployed position. The limit member may additionally be restrainably affixable to at least a portion of the frame means, to further facilitate the locking of the clamping means in secure engagement of the lower surface of the elevated member.

In a preferred embodiment, the securement means comprises two cam members, each fixed for rotation with the seat member and positioned an opposing sides of the seat member, relative to each other.

Also in a preferred embodiment, movement of the securement means from its substantially nonengaging position to its substantially engaging position, such as by movement of the seat member from its substantially undeployed position to its substantially deployed position, causes the securement means to move through and beyond a position of tightest operative engagement between the securement means and the clamping means, locking the clamping means in secure engagement of the lower surface of the elevated member until force is exerted upon the securement means, such as by exerted force upon the seat member, towards moving the securement means back from its substantially engaging position, back through and beyond the position, of tightest operative engagement between the securement means and the clamping means, to its substantially nonengaging position.

In another preferred embodiment, the clamping means further includes a detent region. Movement of the securement means from its substantially nonengaging position to its substantially engaging position, such as by movement of the seat member from its substantially nondeployed position to its substantially deployed position, causes the securement means to engage the detent region, locking the clamping means in secure engagement of the lower surface, and, in turn, locking the seat member in its deployed position, until force is exerted upon the securement means and the seat member towards moving the securement means back from its engagement with the detent region to its substantially nonengaging position.

In one embodiment, the clamping means further includes thickness compensating means for compensating for the thickness of the elevated member. The thickness compensating means comprises a telescoping member operatively attached to the clamping means proximate a portion of the clamping means engaging the lower surface of the elevated member. The telescoping member causes the clamping means to be springedly biased against the lower surface of the elevated member upon attachment of the highchair apparatus to the elevated member.

In another preferred embodiment, the clamping means further includes a toothed rack, and the securement means further includes at least one toothed member. Movement of the securement means from its substantially nonengaging position to its substantially engaging position causes the toothed member to engage the toothed rack, retaining the clamping means in its secure engagement of the lower surface until force is exerted upon the securement means towards moving of the securement means back from its engagement with the toothed rack to its substantially nonengaging position.

In this embodiment, the thickness compensating means includes a plurality of teeth within the toothed rack. The toothed member engages the toothed rack in one of a plurality of engaging positions, corresponding to the thickness of the elevated member.

In this preferred embodiment, a spring member is interposed between the securement means and the clamping means when the securement means is moved from its substantially nonengaging position to its substantially engaging position. The spring member serves to springedly bias the securement means against the clamping means, and, in turn, maintain the toothed member in engagement with the toothed rack until force is exerted upon the securement means towards moving the securement means back to the substantially nonengaging position.

Also in the preferred embodiment, the clamping means may further include a roller member at a third pivot proximate the portion of the clamping means engaging in the lower surface of the elevated member.

BRIEF DESCRIPTION OF THE DRAWINGS

FIG. 1 of the drawings is a perspective view of a highchair apparatus embodying the present invention;

FIG. 2 of the drawings is a side plan view of the highchair apparatus, partially in section, showing, in particular, the seat member in the substantially undeployed position and the cam member in the substantially nonengaging position;

FIG. 3 of the drawings is a side plan view of the highchair apparatus, partially in section, showing, in particular, the seat member in the substantially deployed position and the cam member in the substantially engaging position;

FIG. 4 of the drawings is a front plan view of the highchair apparatus, taken generally along lines 4—4 of FIG. 2;

FIG. 5 is a fragmentary view of another embodiment of the highchair apparatus, showing, in particular, the cam member in engagement with the detent region of the clamping arm;

FIG. 6 of the drawings is a side plan view of another embodiment of the present highchair apparatus invention, partially in section, showing, in particular, the toothed rack, the toothed member, and the spring member in engagement upon attachment of the highchair apparatus to a relatively thin elevated member;

FIG. 7 of the drawings is a side plan view of another embodiment of the present highchair apparatus, partially in section, showing, in particular, the toothed rack, the toothed member, and the spring member in engagement upon attachment of the highchair apparatus to a relatively thick elevated member;

FIG. 8 of the drawings is a perspective view of the toothed rack; and

FIG. 9 of the drawings is a view of a variation of the preferred embodiment.

DETAILED DESCRIPTION OF THE DRAWINGS

While the invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

The present highchair apparatus is shown in FIGS. 1–4 as comprising frame means 30, clamping means 50, securement means 70, seat member 80, thickness compensation means 90, and backrest member 110. Highchair apparatus 20 is releasably attachable to a horizontal elevated member 10, having an upper surface 11, a lower surface 12, and a thickness therebetween. As explained in detail below, the present highchair apparatus is releasably attachable to elevated members having a variety of thicknesses.

As shown in FIGS. 2–3, frame means 30, which supports the highchair apparatus, includes U-shaped member 31, support member 35, connecting members 38, and pivot housings 40. U-shaped member 31 includes two parallel horizontal arms 32, connected by a transverse portion 34. Upon attachment to the elevated member, the end portions of arms 32 are clamped against upper surface 11 of the elevated member and, accordingly, these portion of arms 32 are preferably covered with non-skid members 33. Support member 35, comprising vertical side members 36 connected by transverse portion 37, forms the side supports of frame means 30. Support member 35 and U-shaped member 31 are attached to each other by connecting members 38. Moreover, the transverse portions 34, 37 of both U-shaped member 31 and support member 35, respectively, are each attached to backrest member 110. Two pivot housings 40, are each attached to, and carried by, corresponding side members 36. Each pivot housing houses a first pivot 41 and a second pivot 42.

Clamping means 50 include two clamping arms 51. Each clamping arm 51 is associated with a corresponding pivot housing 40. A portion of each clamping arm 51 is carried within its associated pivot housing 40, and is pivotally attached to the pivot housing, and, in turn, frame means 30, at first pivot 41.

Securement means 70 includes a pair of cam members 71. Each cam member is pivotally attached to frame means 30 at a corresponding second pivot 42, and is carried within an associated pivot housing 40. Each cam member is movable from a substantially horizontal, nonengaging position (FIG. 2) to a substantially vertical, engaging position (FIG. 4) with respect to clamping arm 51. Each cam member 71 further includes a detented position 73 (FIG. 4) proximate the lobe end of the cam member. Detented region 73 is sized and curved to provide relatively smooth movement of cam member 71 along the surface of clamping arm 51, as cam member 71 is moved from its substantially nonengaging position to its substantially engaging position. Although, in the preferred embodiment, cam member 71 and a portion of clamping arm 51 are concealed within pivot housing 40, other embodiments are also contemplated, such as embodiments having exposed cam members and fully exposed clamping arms.

This engagement of clamping arm 51 by cam member 71 causes clamping arm 51 to pivot about its corresponding first pivot 41, which, upon attachment of highchair apparatus 20 to an elevated member, serves to clamp the elevated member securely between a portion of clamping arms 51 and horizontal arms 32.

As shown in FIG. 3, movement of securement means 70 from its substantially nonengaging position to is substantially engaging position causes each cam member 71 to move through and beyond a position of tightest operative engagement 52 between each cam member 71 and its associated clamping arm 51, within pivot housing 40. This, in turn, prompts movement of clamping arm 51 from a clamping position to a nonclamping position, serving to lock clamping means 50 in secure engagement of lower surface 12 of elevated member 10, until force is exerted upon securement means 70, towards moving the securement means back through and beyond the position of tightest operative engagement 52 between the securement means and the clamping means, when moving cam member 71 from its substantially engaging position back to its substantially nonengaging position.

Seat member 80 is fixed for rotation with both cam members 71. Shaft 43 (FIG. 4), attached to seat member 80, extends transversely between both pivot housings 40. Each end of shaft 43 is attached to a cam member 71 at second pivot 42. Seat member 80 is movable from a substantially upright, nondeployed position (FIG. 2), to a substantially horizontal, deployed position (FIG. 3). Since seat member 80 is fixed for rotation with cam members 71 through shaft 43, movement of seat member 80 from its substantially undeployed position to its substantially deployed position, in turn causes movement of cam members 71 from their substantially nonengaging position to their substantially engaging position, as shown in FIGS. 2–3.

As shown in FIG. 1, seat member 80 includes an upper surface 81, and a horn member 82 attached to the upper surface. Horn member 82 is positioned between the legs of a child seated upon seat member 80, when seat member 80 is in its substantially deployed position, serving to substantially preclude the child from sliding forward and out of highchair apparatus 20.

Limit members 83 are attached to opposing sides of seat member 80. When seat member 80 is moved to its substantially deployed position, limit members 83 engage corresponding portions of side members 36 of frame means 30. This, in turn, prevents any further, unwanted movement of seat member 80 beyond its deployed position, upon attachment of highchair apparatus 20 to elevated member 10, and enhances stabilization of seat member 80 in its substantially deployed position. If desired, limit members 83 may be restrainably affixable to frame means 30, such as by a snap fit with side members 36, to further facilitate locking the clamping means in secure engagement of the lower surface of the elevated member.

Clamping means 50 further include thickness compensating means 90, for compensating for the thickness of the elevated member to which highchair apparatus 20 is to be attached. As shown in the preferred embodiment of FIGS. 2–3, thickness compensating means 90 includes telescoping member 91, operatively attached to clamping means 50 proximate a portion of clamping arm 51 engaging the lower surface of elevated member 10, upon attachment of the highchair apparatus to the elevated member.

Telescoping member 91 comprises a piston, having central bore 93, and slot 94 communicating with bore 93. Bore 93 receives one end of clamping arm 51, which includes pin 95 disposed within slot 94. Pin 95 and slot 94 cooperate so as to define a maximum length of travel (i.e. maximum compression and expansion) of piston 91 with respect to clamping arm 51. Spring 92 serves to springedly bias piston 91 with respect to clamping arm 51. One end of spring 92 is attached to clamping arm 51 at center groove 97 of grommet 96. Another end of spring 92 is attached to piston 91 at groove 98. A flexible bellows cover 99 serves to protectively cover and conceal spring 92. Inasmuch as piston 91 is clamped against lower surface 12 of elevated member 10 upon attachment of highchair apparatus 20 to the elevated member, piston 91 is preferably constructed of, or coated with, a non-skid material.

In operation, highchair apparatus 20 is attached to elevated member 10 in the following manner. First, arms 32 of U-shaped member 31 are positioned atop elevated member 10, in contact with upper surface 11. Next, seat member 80 is moved from its substantially undeployed position to its substantially deployed position. This, in turn, causes cam member 71 to move from its substantially undeployed position, through the position of tightest operative engagement 52 with clamping arms 51, to its substantially engaging position. This, in turn, causes clamping arms 51 to pivot about their corresponding first pivot 41 and, in turn, causes telescoping member 91 to come into contact with lower surface 12 of elevated member 10. Elevated member 10 is thus securely clamped between horizontal arms 32 of U-shaped member 31 and clamping arms 51. Telescoping member 91 ensures that this secure clamping is maintained, for varying thicknesses of elevated member 10.

To remove highchair apparatus 20 from elevated member 10, seat member 80 is moved back from its substantially deployed position to its substantially undeployed position. This, in turn, causes cam member 71 to move from its substantially engaging position, back through the position of tightest operative engagement 52 with clamping arm 51, to its substantially nonengaging position. This, in turn, releases clamping arm 51, causing telescoping member 91 to drop away from lower surface 12 of elevated member 10. Highchair apparatus 20 is then lifted away from elevated member 10.

Another preferred embodiment of the clamping arm is shown in FIG. 5. In this embodiment, clamping arms 51' includes detent region 53. Movement of cam member 71 from its substantially nonengaging position to its substantially engaging position causes the lobe end of cam member 71 to engage detent region 53. This, in turn, locks clamping means 50 in secure engagement of the lower surface of elevated member 10, until force is exerted upon cam member 71, such as by exerting a lifting force upon seat member 80, towards moving the seat member back from its substantially deployed position to its substantially undeployed position and, in turn, toward moving cam member 71 back from its engagement with detent region 53 to its substantially nonengaging position.

Another preferred embodiment of the present highchair apparatus is shown in FIGS. 6–8. In this embodiment, clamping arm 51" includes a first cap member 54 and a second cap member 55. First cap member 54 is attached to clamping arm 51" proximate the portion of clamping arm 51" which engages lower surface 12 of elevated member 10. Accordingly, first cap member 54 is preferably constructed of, or coated with, a substantially non-skid material.

Second cap member 55, shown in detail in FIG. 8, includes toothed rack 56, bore 57, and slot 58 communicating with bore 57. Bore 57 accepts another end of clamping arm 51". Slot 58 receives one end of leaf spring member 100.

Also, in this embodiment, cam member 71' includes a plurality of toothed members 72, along one side of cam member 71' and proximate the lobe end.

When attaching highchair apparatus 20 to elevated member 10, movement of cam member 71' from its substantially nonengaging position to its substantially engaging position causes the lobe end of cam member 71' to engage the free end of leaf spring member 100, and causes toothed members 72 of cam member 71' to engage toothed rack 56, in one of a plurality of potential engaging positions of toothed rack 56. This movement of cam member 71' to its substantially engaging position causes cam member 71' to move through and beyond a position of tightest operative engagement 52' with the free end of leaf spring member 100. As shown in FIGS. 6 and 7, the position within rack 56 where toothed members 72 mesh, upon movement of cam member 71' to its substantially engaging position, depends upon the thickness of elevated member 10. Moreover, in this embodiment, leaf spring 100 serves to springedly bias cam member 71' against toothed rack 56. Accordingly, toothed rack 56, toothed member 72, and leaf spring 100 collectively perform a similar thickness compensating function to telescoping member 91 of the previous preferred embodiment, which is absent from the present preferred embodiment. Also shown in FIG. 6 and 7, the degree of compression of leaf spring member 100 varies in relation to the thickness of elevated member 10. For varying thicknesses of elevated member 10, toothed members 72, toothed rack 56, and leaf spring member 100 accordingly serve to maintain clamping arm 51" securely against lower surface 12 of elevated member 10.

A variation of this preferred embodiment is shown in FIG. 9. In this variation, first cap member 54 is replaced with roller member 60, which is disposed about one end of clamping arm 51'''. Roller member 60 is eccentrically, pivotally attached to clamping arm 51''' at third pivot 59. Inasmuch as roller member 60 maintains contact with lower side 12 of elevated member 10 upon attachment of the highchair apparatus to the elevated member, roller member 60 is preferably constructed of, or coated with, a substantially non-skid material.

The foregoing description and drawings merely explain and illustrate the invention and the invention is not limited thereto except insofar as the appended claims are so limited, as though skills in the art to have the disclosure before them will be able to make modifications and variations therein without departing from the scope of the invention.

What is claimed is:

1. A highchair apparatus for attachment to an elevated member having an upper surface, a lower surface and a thickness therebetween, said highchair apparatus comprising:

frame means for supporting said highchair apparatus, at least a portion of said frame means engaging said upper surface of said elevated member upon said attachment of said highchair apparatus to said elevated member;

clamping means pivotally attached to said frame means at a first pivot for clamping said highchair apparatus to said elevated member, at least a portion of said clamping means engaging said lower surface of said elevated member upon attachment of said highchair apparatus to said elevated member; and securement means pivotally attached to a second pivot and operably associated with said clamping means for imparting movement of said clamping means about said first pivot and restrainably securing said highchair apparatus to said elevated member through clamping engagement of said at least a portion of said frame means and said clamping means with said upper and lower surfaces of said elevated member, respectively, said securement means cooperatively engaging said clamping means upon movement of said securement means from a substantially non-engaging position to a substantially engaging position to, in turn, impart movement of said clamping means from a non-clamping position to a clamping position, securely engaging said lower surface of said elevated member and, in turn, causing said at least a portion of said frame means to securely engage said upper surface of said elevated member, said securement means further serving to lock said clamping means in said secure engagement of said lower surface, and, in turn, said at least a portion of said frame means in said secure engagement of said upper surface, until force is exerted upon said securement means towards moving said securement means back from said substantially engaging position to said substantially nonengaging position.

2. The highchair apparatus according to claim 1, wherein said securement means comprises at least one cam member.

3. The highchair apparatus according to claim 1, wherein movement of said securement means from said substantially nonengaging position to said substantially engaging position causes said securement means to move through and beyond a position of tightest operative engagement between said securement means and said clamping means, locking said clamping means in said secure engagement of said lower surface until force is exerted upon said securement means towards moving said securement means back from said substantially engaging position back through and beyond said position of tightest operative engagement between said securement means and said clamping means to said substantially nonengaging position.

4. The highchair apparatus according to claim 1, wherein said clamping means further includes a detent region, and movement of said securement means from said substantially nonengaging position to said substantially engaging position causes said securement means to engage said detent region, locking said clamping means in said secure engagement of said lower surface until force is exerted upon said securement means towards moving said securement means back from said engagement with said detent region to said substantially nonengaging position.

5. The highchair apparatus according to claim 1, wherein said clamping means further includes a toothed rack and said securement means further includes a toothed member, movement of said securement means from said substantially nonengaging position to said substantially engaging position causing said toothed member to engage said toothed rack, restraining said clamping means in said secure engagement of said lower surface until force is exerted upon said securement means towards moving said securement means, and, in turn, said toothed member, back from said engagement with said toothed rack to said substantially nonengaging position.

6. The highchair apparatus according to claim 1, wherein said clamping means further includes a roller member pivotally attached to said clamping means at a third pivot proximate said at least a portion of said clamping means engaging said lower surface of said elevated member.

7. The highchair apparatus according to claim 1, wherein said highchair apparatus further includes a seat member pivotally attached to said frame means at said second pivot, said seat member being positionable from a substantially undeployed position to a substantially deployed position.

8. The highchair apparatus according to claim 7, wherein said highchair apparatus further includes a backrest member attached to said frame means, said backrest member and said seat member cooperating to form a chair in which a child may be seated upon movement of said seat member to said deployed position.

9. The highchair apparatus according to claim 7, wherein said seat member includes a top surface, and a horn member proximate said top surface, said horn member being positioned between the legs of a child seated upon said seat member in said substantially deployed position and serving to substantially preclude said child from sliding forward and out of said highchair apparatus.

10. The highchair apparatus according to claim 1, wherein said clamping means further includes thickness compensating means for compensating for variations in said thickness of said elevated member.

11. The highchair apparatus according to claim 10, wherein said thickness compensating means comprising a telescoping member operatively attached to said clamping means proximate said at least a portion of said clamping means engaging said lower surface of said elevated member, said telescoping member causing said clamping means to be springedly biased against said lower surface of said elevated member upon attachment of said highchair apparatus to said elevated member.

12. The highchair apparatus according to claim 10, wherein said securement means further includes a toothed member and said thickness compensating means includes a toothed rack having a plurality of teeth and operatively attached to said clamping means, movement of said securement means from said substantially nonengaging position to said substantially engaging position causing said toothed member to engage said toothed rack in one of a plurality of engaging positions corresponding to said thickness of said elevated member.

13. The highchair apparatus according to claim 12, wherein said thickness compensating means further includes a spring member interposed between said securement means and said clamping means when said securement means is moved from said substantially nonengaging position to said substantially engaging position, said spring member serving to springedly bias said securement means against said clamping means, and, in turn, maintain said toothed member in said engagement with said toothed rack until force is exerted upon said securement means towards moving said securement means back to said substantially nonengaging position.

14. A highchair apparatus for attachment to an elevated member having an upper surface, a lower surface and a thickness therebetween, said highchair apparatus comprising:

frame means for supporting said highchair apparatus, at least a portion of said frame means engaging said upper surface of said elevated member upon said attachment of said highchair apparatus to said elevated member;

clamping means pivotally attached to said frame means at a first pivot for clamping said highchair apparatus to said elevated member, at least a portion of said clamping means engaging said lower surface of said elevated member upon attachment of said highchair apparatus to said elevated member;

securement means pivotally attached to said frame means at a second pivot and operably associated with said clamping means for restraining securing said highchair apparatus to said elevated member through clamping engagement of said at least a portion of said frame means and said clamping means with said upper and lower surfaces of said elevated member, respectively, said securement means cooperatively engaging said clamping means upon movement of said securement means from a substantially nonengaging position to a substantially engaging position to, in turn, prompt movement of said clamping means from a non-clamping position to a clamping position, securely engaging said lower surface of said elevated member and, in turn, causing said at least a portion of said frame means to securely engage said upper surface of said elevated member, said securement means further serving to lock said clamping means in said secure engagement of said lower surface, and, in turn, said at least a portion of said frame means in said secure engagement of said upper surface, until force is exerted upon said securement means towards moving said securement means back from said substantially engaging position to said substantially nonengaging position; and a seat member pivotally attached to said frame means at said second pivot, said seat member being positionable from a substantially undeployed position to a substantially deployed position, said securement means being fixed for rotation with said seat member, said securement means cooperatively engaging said clamping means so as to releasably force said clamping means into said secure engagement of said lower surface of said elevated member upon said prompted movement of said clamping means, when said seat member is moved from said substantially undeployed position to said substantially deployed position.

15. The highchair apparatus according to claim 14, wherein said securement means comprises two cam members, said two cam members being fixed for rotation with said seat member and positioned on opposing sides of said seat member relative to each other.

16. The highchair apparatus according to claim 14, wherein movement of said seat member from said substantially undeployed position to said substantially deployed position causes said securement means to move through and beyond a position of tightest operative engagement between said securement means and said clamping means, locking said clamping means in said secure engagement of said lower surface and locking said seat member in said deployed position until force is exerted upon said seat member towards moving said seat member back from said substantially deployed position to said substantially deployed position, and, in turn, towards moving said securement means back through and beyond said position of tightest operative engagement between said securement means and said clamping means.

17. The highchair apparatus according to claim 14, wherein said clamping means further includes a detent region, and movement of said seat member from said substantially undeployed position to said substantially deployed position causes said securement means to engage said detent region, locking said clamping means in said securement of said lower surface and locking said seat member in said substantially deployed position until force is exerted upon said seat member towards moving said seat member back from said substantially deployed position to said substantially undeployed position, and, in turn, towards moving said securement means back from said engagement with said detent region to said substantially nonengaging position.

18. The highchair apparatus according to claim 14, wherein said clamping means further includes a toothed rack and said securement means further includes a toothed member, movement of said seat member from substantially nonengaging position to said substantially engaging position causing said toothed member to engage said toothed rack, restraining said clamping means in said secure engagement of said lower surface and locking said seat member in said deployed position until force is exerted upon said seat member towards moving said seat member back from said substantially deployed position to said substantially undeployed position.

19. A highchair apparatus for attachment to an elevated member having an upper surface, a lower surface and a thickness therebetween, said highchair apparatus comprising:

frame means for supporting said highchair apparatus, at least a portion of said frame means engaging said upper surface of said elevated member upon said attachment of said highchair apparatus to said elevated member;

clamping means pivotally attached to said frame means at a first pivot for clamping said highchair apparatus to said elevated member, at least a portion of said clamping means engaging said lower surface of said elevated member upon attachment of said highchair apparatus to said elevated member;

securement means pivotally attached to said frame means at a second pivot and operably associated with said clamping means for restraining securing said highchair apparatus to said elevated member through clamping engagement of said at least a portion of said frame means and said clamping means with said upper and lower surfaces of said elevated member, respectively, said securement means cooperatively engaging said clamping means upon movement of said securement means from a substantially nonengaging position to a substantially engaging position to, in turn, prompt movement of said clamping means from a non-clamping position to a clamping position, securely engaging said lower surface of said elevated member and, in turn, causing said at least a portion of said frame means to securely engage said upper surface of said elevated member said securement means further serving to lock said clamping means in said secure engagement of said lower surface, and, in turn, said at least a portion of said frame means in said secure engagement of said upper surface, until force is exerted upon said securement means towards moving said securement means back from said substantially engaging position to said substantially nonengaging position; and a seat member pivotally attached to said frame means at said second pivot, said seat member being positionable from a substantially undeployed position to a substantially deployed position, said seat member further including at least one limit member operatively attached to said seat member, said limit member releasably engaging at least a portion of said frame means when said seat member is in said substantially deployed position, to, in turn, enhance stabilization of said seat member in said substantially deployed position.

20. The highchair apparatus according to claim 19, wherein said limit member is restrainably affixable to said at least a portion of said frame means when said seat member is in said substantially deployed position, to in turn further facilitate said locking of said clamping means in said secure engagement of said lower surface of said elevated member.

* * * * *

UNITED STATES PATENT AND TRADEMARK OFFICE

CERTIFICATE OF CORRECTION

PATENT NO. : 5,480,211

DATED : January 2, 1996

INVENTOR(S) : Douglas et al.

It is certified that error appears in the above-indentified patent and that said Letters Patent is hereby corrected as shown below:

Col. 1, line 11 Delete "apparatuses often" and insert instead -- apparatuses are often --.

Col. 1, line 43 Delete "operably independently" and insert instead -- operably independent --.

Col. 4, line 26 Delete "the invention" and insert instead -- this invention --.

Col. 4, line 50 Delete "these portion" and insert instead -- these portions --.

Col. 5, line 8 Delete "detented position" and insert instead -- detented region --.

Col. 7, line 6 Delete "toward" and insert instead -- towards --.

Col. 9, line 38 Delete "comprising" and insert instead -- comprises --.

Col. 10, line 18 Delete "restraining" and insert instead -- restrainably --.

Col. 11, line 12 Delete "securement" and insert instead -- secure engagement --.

UNITED STATES PATENT AND TRADEMARK OFFICE

CERTIFICATE OF CORRECTION

PATENT NO. : 5,480,211

DATED : January 2, 1996

INVENTOR(S) : Douglas et al.

It is certified that error appears in the above-indentified patent and that said Letters Patent is hereby corrected as shown below:

Col. 12, line 4 Delete "restraining securing" and insert instead — restrainably securing —.

Signed and Sealed this

Twenty-seventh Day of July, 1999

*Attest:*

*Attesting Officer*

Q. TODD DICKINSON

*Acting Commissioner of Patents and Trademarks*